US005980437A

United States Patent [19]

Yang

[11] Patent Number: 5,980,437

[45] Date of Patent: Nov. 9, 1999

[54] BODY EXERCISER WITH PECTORAL AND LIFTING EXERCISING FUNCTIONS

[76] Inventor: Yen-Shuo Yang, 2F-3, No. 3, Wu-Chang S. St., Pei Dist, Taichung, Taiwan

[21] Appl. No.: 09/304,971

[22] Filed: May 4, 1999

[51] Int. Cl.[6] ..... A63B 21/04

[52] U.S. Cl. ..... 482/130; 482/130; 482/136; 482/137; 482/138

[58] Field of Search ..... 482/100, 112, 482/113, 121, 129, 130, 133, 136–138; D21/673, 676

[56] References Cited

U.S. PATENT DOCUMENTS

D. 329,672 9/1992 Shieh ..... D21/195
5,665,036 9/1997 Hsieh ..... 402/100

*Primary Examiner*—John Mulcahy

*Attorney, Agent, or Firm*—Brinks Hofer Gilson & Lione

[57] ABSTRACT

A body exerciser includes an elongated base, a pulley member, a pair of swing arms and an elastic band. The base has an upright support extending upwardly therefrom. A seat is disposed on and projects forwardly of the upright support. An inverted T-shaped member has an upper upright portion and a lower horizontal portion. The upper upright portion has a top distal end connected pivotally to a top distal end of the upright support for turning forward and upward from a vertically suspended position. The pulley member is mounted on the upright support rearwardly of the lower horizontal portion and below the top distal end of the upper upright portion. The swing arms are connected pivotally and respectively to end portions of the lower horizontal portion so as to move forwardly toward one another. The elastic band passes over the pulley member and has two ends connected to the swing arms, respectively, in order to provide resistance against upward movement of the inverted T-shaped member and against forward movement of the swing arms.

4 Claims, 5 Drawing Sheets

BODY EXERCISER WITH PECTORAL AND LIFTING EXERCISING FUNCTIONS

BACKGROUND OF THE INVENTION

1. Field of the Invention

This invention relates to a body exerciser, more particularly to a body exerciser with pectoral and lifting exercising functions.

2. Description of the Related Art

Referring to FIG. 1, a conventional body exerciser 10 is shown to comprise a base 11, an upright support 12 mounted on the base 11, a seat 13 mounted forwardly of the upright support 12, two rods 14 mounted rearwardly of the upright support 12, and a plurality of weights 15 disposed slidably on the rods 14. The upright support 12 has an inverted T-shaped member 19 connected thereto. The inverted T-shaped member 19 has an upper upright portion 191 connected pivotally to a top end of the upright support 12, and a lower horizontal portion 192 connected transversely to the upper upright portion 191. The lower horizontal portion 192 has two swing arms 16 connected pivotally to two ends thereof and capable of turning forwardly toward one another. Further, the swing arms 16 and the inverted T-shaped member 19 are turnable together forwardly and upwardly about the top end of the upright support 12 from a vertical suspended position. A steel cable 17 interconnects top portions of the swing arms 16 and the weights 15 via plural 18. In this way, the user can sit on the seat 13 and turn either the swing arms 16 forwardly or the inverted T-shaped 19 forwardly and upwardly against the action of the weights 15. Therefore, the user can exercise his/her dorsal muscles, arm muscles, thoracic muscles, etc. with the use of the conventional body exerciser 10. However, the conventional body exerciser 10 is bulky and heavy because it has a plurality of metal pulleys 18 and metal weights 15 disposed thereon. In addition, when the weights 15 are moved up and down, collision among the weights 15 generates loud noise.

SUMMARY OF THE INVENTION

The object of the present invention is to provide a body exerciser that is compact and light in weight.

Another object of the present invention is to provide a body exerciser that can be operated silently.

According to the present invention, the body exerciser comprises an elongated base, a pulley member, a pair of swing arms and an elastic band. The base has an upright support extending upwardly therefrom between front and rear ends of the base. A seat is disposed on and projects forwardly of the upright support. An inverted T-shaped member has an upper upright portion and a lower horizontal portion connected transversely to the upper upright portion. The lower horizontal portion has two end portions extending sideward. The upper upright portion has a top distal end connected pivotally to a top distal end of the upright support for turning forward and upward from a vertically suspended position. The pulley member is mounted on the upright support rearwardly of the lower horizontal portion and below the top distal end of the upper upright portion. The swing arms are connected pivotally and respectively to the end portions of the lower horizontal portion. The swing arms are movable forwardly toward one another. The elastic band passes over the pulley member and has two ends connected to the swing arms, respectively, in order to provide resistance against upward movement of the inverted T-shaped member and against forward movement of the swing arms.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
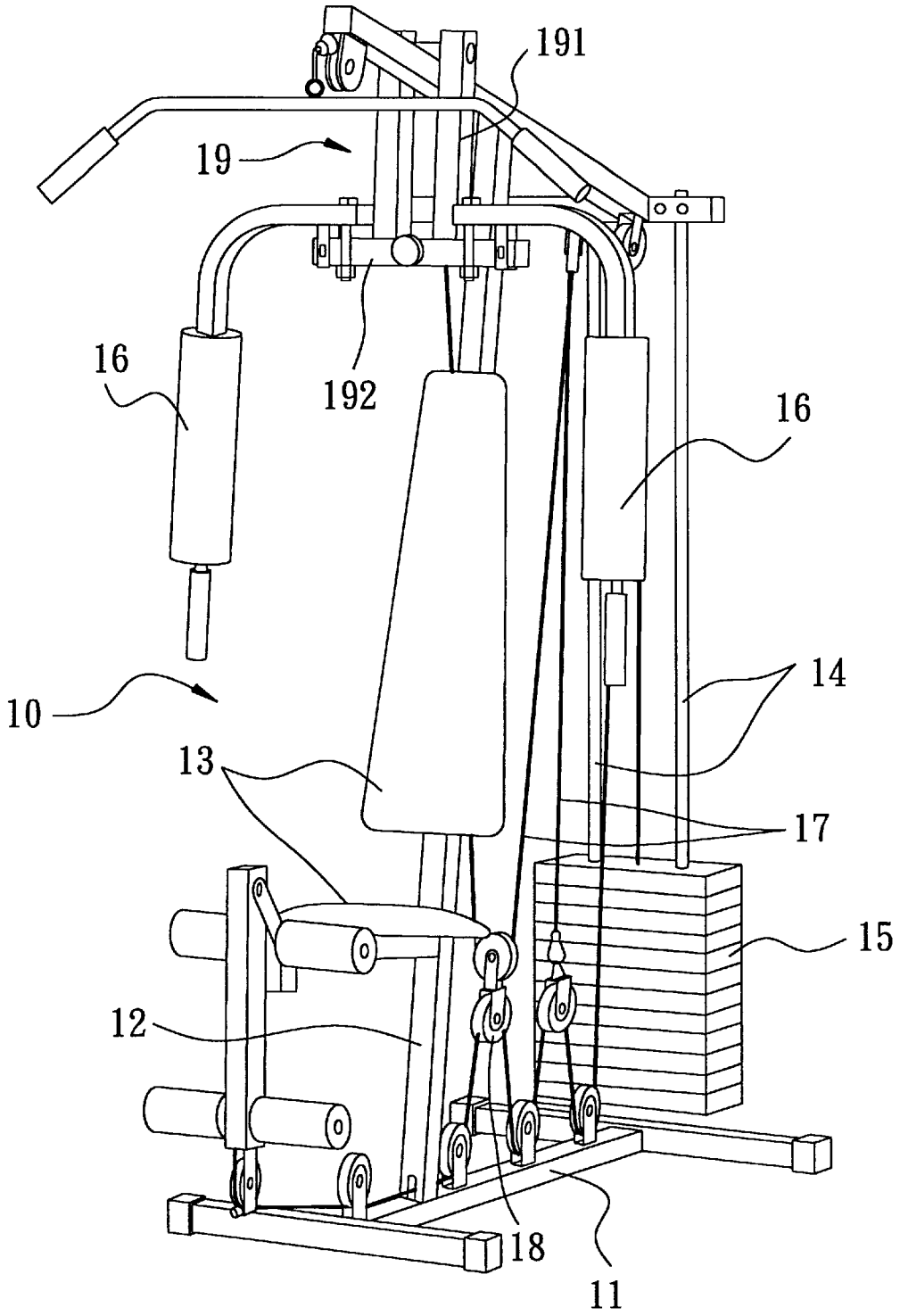
FIG. 1 PRIOR ART
FIG. 1 is a perspective view of a conventional body exerciser.
Figure 2:
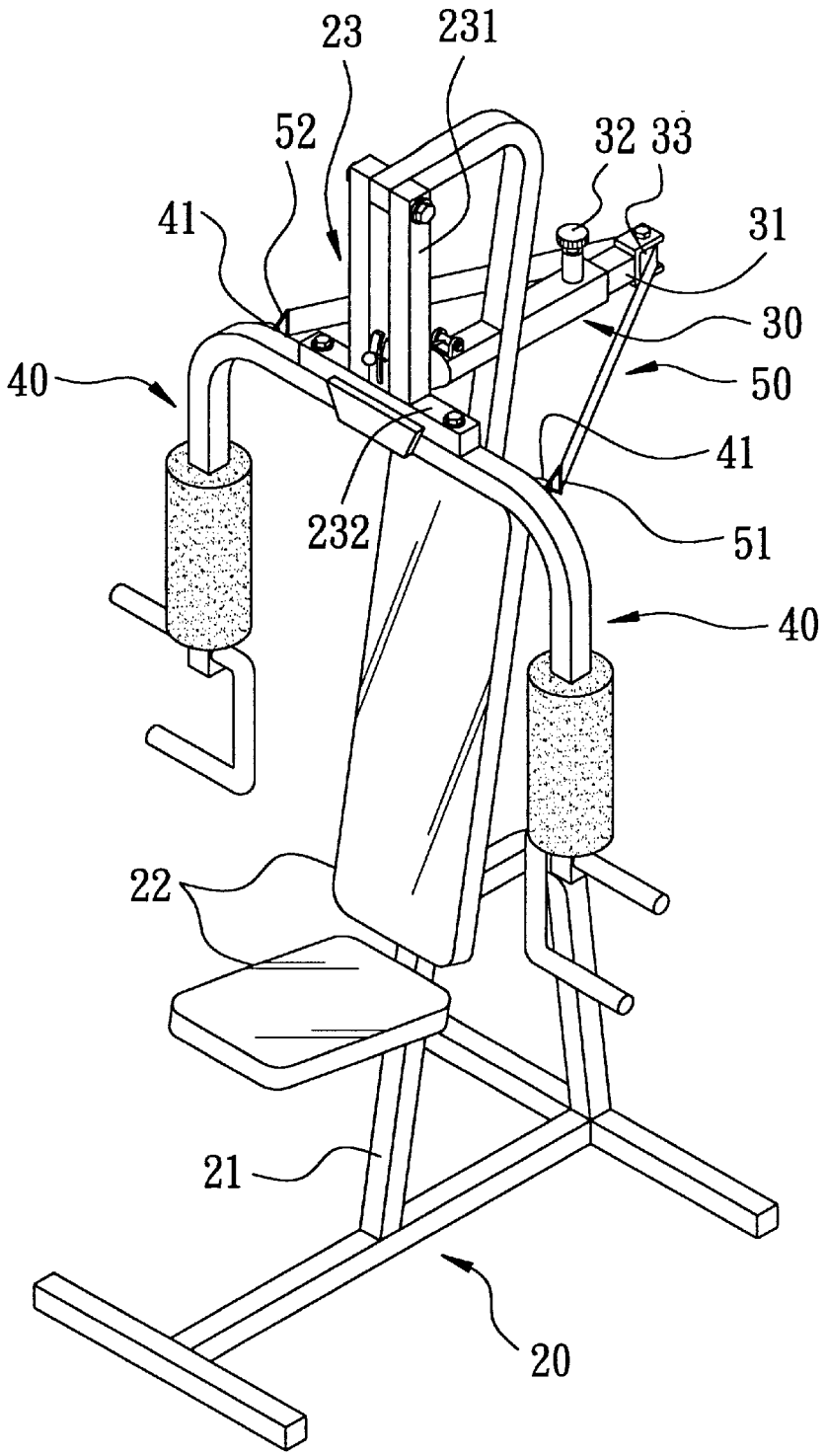
FIG. 2 is a perspective view of a preferred embodiment of a body exerciser according to the present invention.

Referring to FIG. 2, a preferred embodiment of a body exerciser according to the present invention is shown to comprise an elongated base 20, a pair of swing arms 40 and an elastic band 50.

The base 20 has an upright support 21 extending upwardly therefrom between front and rear ends of the base 20. A seat 22 is disposed on and projects forwardly of the upright support 21. An inverted T-shaped member 23 is connected to a top distal end of the upright support 21. The inverted T-shaped member 23 has an upper upright portion 231 and a lower horizontal portion 232 connected transversely to the upper upright portion 231. The lower horizontal portion 232 has two end portions extending sideward. The upper upright portion 231 has a top distal end connected pivotally to the top distal end of the upright support 21 for turning forward and upward from a vertically suspended position.

Figure 3:
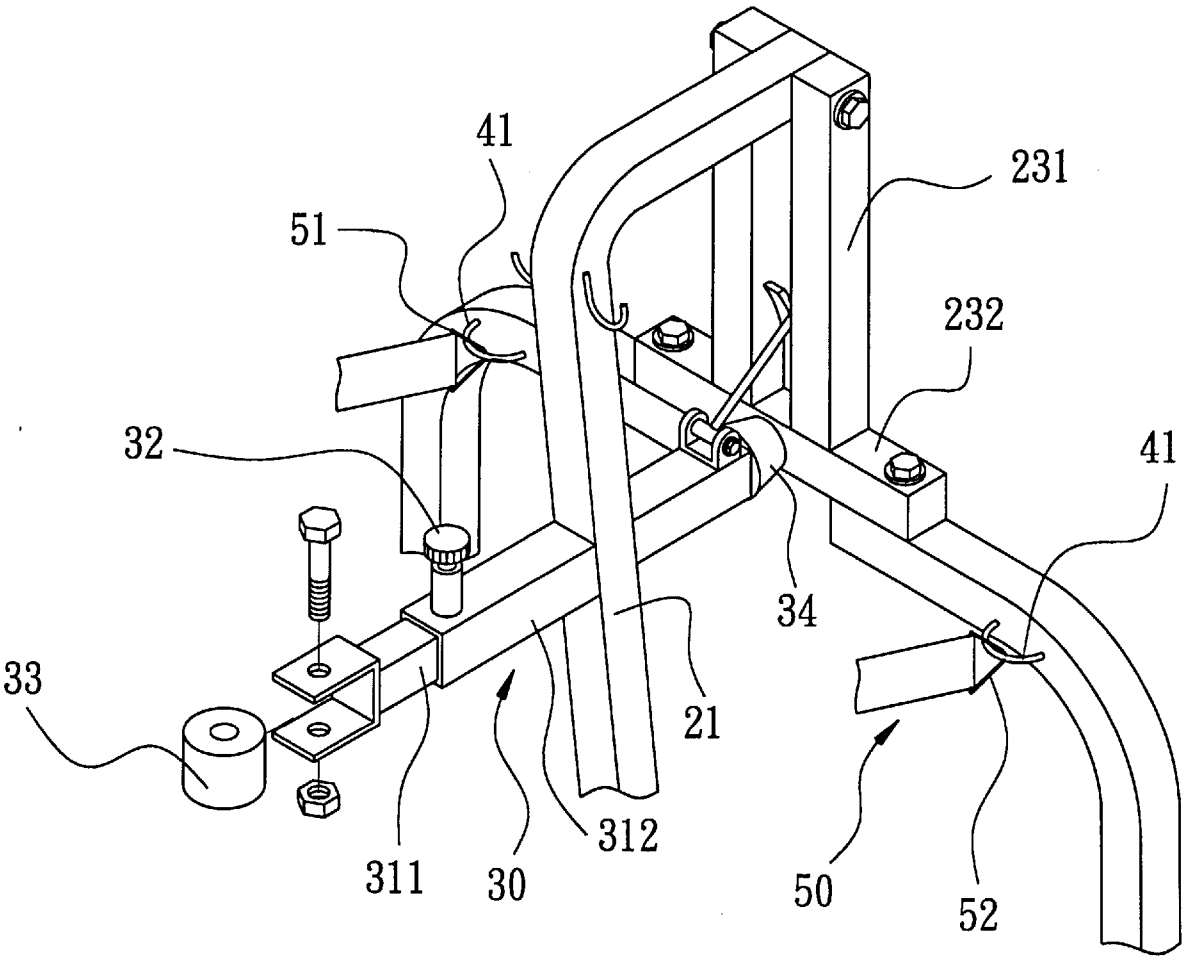
FIG. 3 is a fragmentary partly exploded view of the preferred embodiment of the body exerciser according the present invention.
Figure 4:
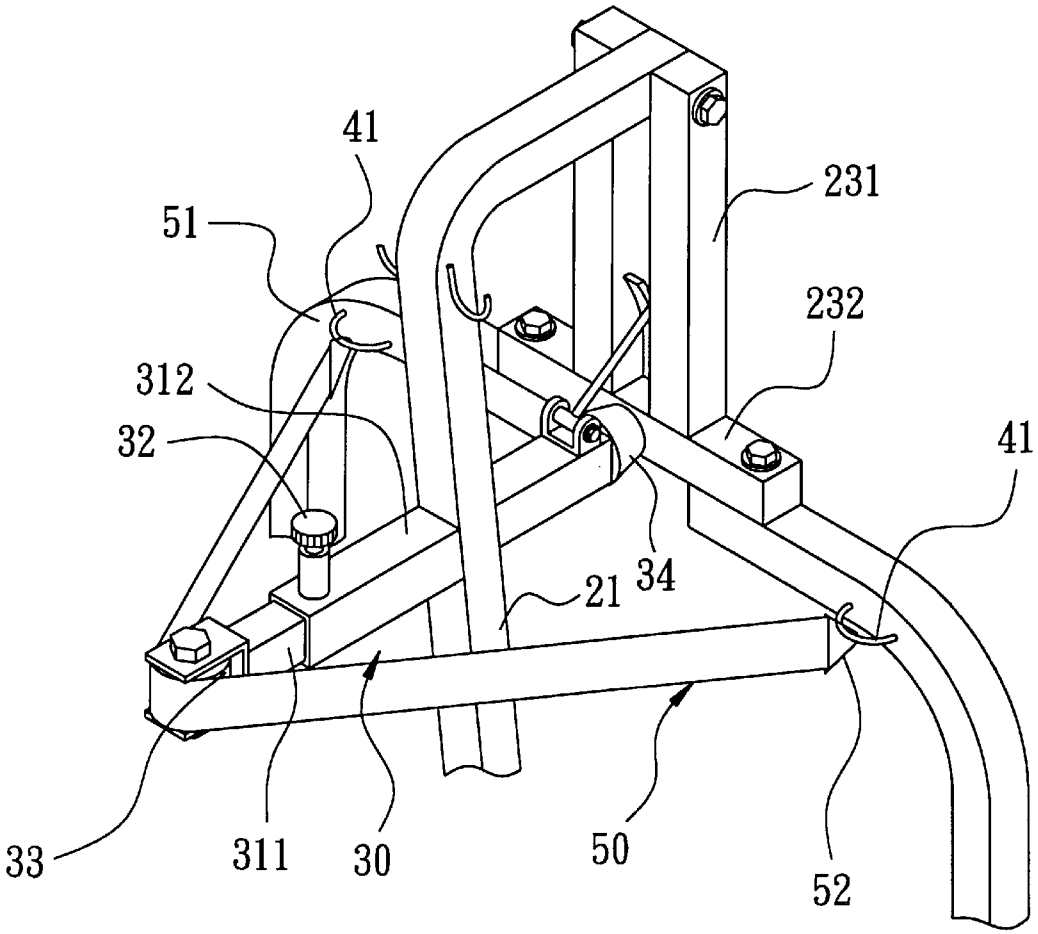
FIG. 4 is a fragmentary perspective view of the preferred embodiment of the body exerciser according the present invention.

Referring to FIGS. 2, 3 and 4, the upright support 21 further has a horizontal stay rod 30 which has a rear end supporting a pulley member 33 and a front end 34 extending to stop the lower horizontal portion 232 from moving rearwardly from the vertically suspended position. The pulley member 33 is mounted rearwardly of the lower horizontal portion 232 and below the top distal end of the upper upright portion 231.

The swing arms 40 are connected pivotally and respectively to the end portions of the lower horizontal portion 232. The swing arms 40 are movable forwardly toward one another. The elastic band 50 passes over the pulley member 33 and has two ends connected to the swing arms 40, respectively, in order to provide resistance against upward movement of the inverted T-shaped member 23 and against forward movement of the swing arms 40. Specifically, the lower horizontal portion 232 has two hook members 41 connected respectively adjacent to the end portions thereof. The elastic band 50 has two loop members 51, 52 connected respectively to the ends thereof. Each of the hook members 41 is connected detachably to a respective one of the loop members 51, 52.

The stay rod 30 includes first and second sections 311, 312 telescoped to one another, and a locking bolt 32 to position the first and second sections 311, 312 relative to one another. The first section 311 is connected to the pulley member 33. The second section 312 is fixed to the upright support 21. As such, the tension of the elastic band 50 can be increased and decreased by moving the first section 311 relative to the second section 322.

Figure 5:
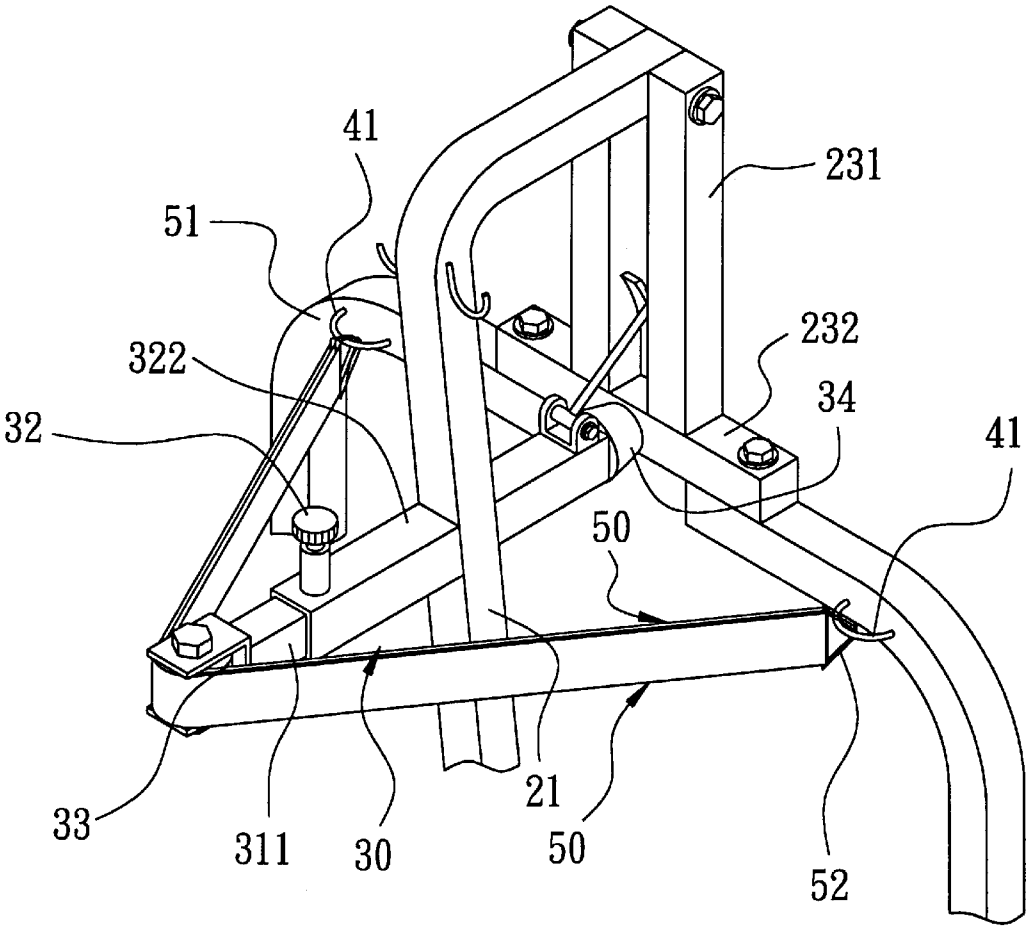
FIG. 5 illustrates how plural elastic bands are mounted on the preferred embodiment of the body exerciser according to the present invention.

Moreover, the resistance experienced by the user during the upward movement of the inverted T-shaped member 23 and the forward movement of the swing arms 40 can be increased by interconnecting a plurality of the elastic bands 50 and the hook members 41, as best illustrated in FIG. 5.

It is noted that, by replacing the heavy and bulky weights employed in the aforementioned conventional body exerciser 10 with the lightweight, flexible elastic band 50, the weight and the volume of the body exerciser of this invention can be reduced effectively and dramatically. In addition, no noise is produced during the operation of the body exerciser. The objects of the present invention are thus met.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A body exerciser comprising:

an elongated base having a front end, a rear end, an upright support extending upwardly from said base between said front and rear ends and having a top distal end, a seat projecting forwardly of said upright support, and an inverted T-shaped member having an upper upright portion and a lower horizontal portion connected transversely to said upper upright portion, said lower horizontal portion having two end portions extending sideward, said upper upright portion having a top distal end connected pivotally to said top distal end of said upright support for turning forward and upward from a vertically suspended position;

a pulley member mounted on said upright support rearwardly of said lower horizontal portion and below said top distal end of said upper upright portion;

a pair of swing arms connected pivotally and respectively to said end portions of said lower horizontal portion, said swing arms being movable forwardly toward one another; and an elastic band passing over said pulley member and having two ends connected to said swing arms, respectively, in order to provide resistance against upward movement of said inverted T-shaped member and against forward movement of said swing arms.

2. The body exerciser as claimed claim 1, wherein said upright support includes a horizontal stay rod which has a rear end supporting said pulley member and a front end extending to stop said lower horizontal portion from moving rearwardly from the vertically suspended position.

3. The body exerciser as claimed claim 2, wherein said stay rod includes two sections telescoped to one another and a locking bolt to position said sections relative to one another, one of said sections being fixed to said upright support, the other one of said sections being connected to said pulley member.

4. The body exerciser as claimed claim 1, wherein said lower horizontal portion has two hook members connected respectively adjacent to said end portions thereof, said elastic band having two loop members connected respectively to said ends thereof, each of said hook members being connected detachably to a respective one of said loop members.

* * * * *

UNITED STATES PATENT AND TRADEMARK OFFICE

CERTIFICATE OF CORRECTION

PATENT NO. : 5,980,437

DATED : November 9, 1999

INVENTOR(S) : Yen-Shuo Yang

It is certified that error appears in the above-identified patent and that said Letters Patent is hereby corrected as shown below:

In claim 2, line 1, delete "as claimed claim 1" and substitute --as claimed in claim 1-- in its place.

In claim 3, line 1, delete "as claimed claim 2" and substitute --as claimed in claim 2-- in its place.

In claim 4, line 1, delete "as claimed claim 1" and substitute --as claimed in claim 1-- in its place.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*